US010808441B2

(12) United States Patent
Fontijn et al.

(10) Patent No.: US 10,808,441 B2
(45) Date of Patent: Oct. 20, 2020

(54) SLIDING DOOR AND WINDOW ROLLER ASSEMBLY

(71) Applicant: GOLDBRECHT INC., Culver City, CA (US)

(72) Inventors: Marcel Fontijn, Culver City, CA (US); Thomas Kern, Culver City, CA (US)

(73) Assignee: GOLDBRECHT INC., Culver City, CA (US)

( * ) Notice: Subject to any disclaimer, the term of this patent is extended or adjusted under 35 U.S.C. 154(b) by 0 days.

(21) Appl. No.: 15/759,607

(22) PCT Filed: Sep. 14, 2017

(86) PCT No.: PCT/US2017/051565

§ 371 (c)(1),
(2) Date: Mar. 13, 2018

(87) PCT Pub. No.: WO2018/053131

PCT Pub. Date: Mar. 22, 2018

(65) Prior Publication Data

US 2019/0194991 A1 Jun. 27, 2019

Related U.S. Application Data

(60) Provisional application No. 62/395,014, filed on Sep. 15, 2016.

(51) Int. Cl.
*E05D 13/00* (2006.01)
*E05D 15/06* (2006.01)
(Continued)

(52) U.S. Cl.
CPC ..... *E05D 15/0665* (2013.01); *E05D 15/06* (2013.01); *E06B 3/42* (2013.01);
(Continued)

(58) Field of Classification Search
CPC ..... E05D 15/0665; E05D 15/06; E05B 3/42; E05B 3/46; E05Y 2800/244; E05Y 2201/684; Y10T 16/364
(Continued)

(56) References Cited

U.S. PATENT DOCUMENTS 885,970 A * 4/1908 Barr ..... E05D 15/0634 16/105
1,689,665 A * 10/1928 Cramp ..... E05D 15/0639 16/103
(Continued)

FOREIGN PATENT DOCUMENTS

CA 3002024 A1 * 3/2018 ..... E05D 15/0665

OTHER PUBLICATIONS

Written Opinion of the International Searching Authority of PCT/US2017/051565 dated Jan. 29, 2018.
(Continued)

*Primary Examiner* — Jerry E Redman
(74) *Attorney, Agent, or Firm* — Sughrue Mion, PLLC

(57) ABSTRACT

A sliding roller assembly includes a plurality of blocks, configured to be connected in series, at least one roller device provided between each of the plurality of blocks, where the roller device includes a main body having at least one roller bearing disposed in the main body.

13 Claims, 7 Drawing Sheets

(51) Int. Cl.
*E06B 3/46* (2006.01)
*E06B 3/42* (2006.01)

(52) U.S. Cl.
CPC ..... *E06B 3/46* (2013.01); *E05Y 2201/684* (2013.01); *E05Y 2201/69* (2013.01); *E05Y 2800/21* (2013.01); *E05Y 2800/23* (2013.01); *E05Y 2800/244* (2013.01)

(58) Field of Classification Search
USPC ..... 49/409, 410, 425, 447, 449
See application file for complete search history.

(56) References Cited

U.S. PATENT DOCUMENTS 1,792,568 A * 2/1931 Boedtcher ..... E05D 15/063 16/106
3,176,757 A * 4/1965 Lomaz ..... E05D 15/24 160/209
3,345,676 A * 10/1967 Graber ..... A47H 15/02 16/87.6 R
3,517,459 A * 6/1970 Schupper ..... E05D 15/0665 49/425
3,698,035 A * 10/1972 Salzmann ..... A47H 1/04 16/95 D
3,736,620 A * 6/1973 Williamson ..... A47H 13/00 16/87.4 R
3,813,728 A * 6/1974 Johnson ..... E05D 15/063 16/97
3,950,952 A * 4/1976 Krings ..... E02D 17/08 405/282
5,035,025 A * 7/1991 Morris ..... E04B 2/827 16/95 R
5,090,171 A * 2/1992 Kano ..... E04B 2/827 160/199
5,542,149 A * 8/1996 Yu ..... A47H 15/02 16/87.4 R
5,950,279 A * 9/1999 Chaput ..... A47H 1/08 16/105
6,141,827 A * 11/2000 Wu ..... A47H 5/02 16/106
6,553,620 B2 * 4/2003 Guillemet ..... E05D 13/1276 16/197
6,983,512 B2 * 1/2006 De Oliveira ..... E05D 15/063 16/87 R
7,117,559 B1 * 10/2006 Barber ..... E05D 15/063 16/97
7,703,242 B2 * 4/2010 Goebel ..... E05D 15/0621 16/102
7,891,052 B2 * 2/2011 Haab ..... E05D 15/0634 16/105
8,240,089 B2 8/2012 Lambertini
8,297,334 B2 * 10/2012 Chu ..... E06B 9/36 160/222
8,418,318 B2 * 4/2013 Scharf ..... A47H 5/032 16/106
8,490,331 B2 * 7/2013 Quesada ..... E05D 15/0665 16/18 R
8,733,023 B2 * 5/2014 Rahardjo ..... B66B 13/08 16/91
8,850,659 B2 * 10/2014 Ewing ..... E05D 15/0634 16/105
9,458,654 B2 * 10/2016 Palsson ..... E05D 15/0634
9,708,843 B2 * 7/2017 Geysels ..... E04F 21/0023
9,926,735 B2 * 3/2018 Goossens ..... E05F 17/00
2002/0170234 A1 * 11/2002 Salice ..... E05D 15/063 49/453
2004/0173117 A1 * 9/2004 Galpin ..... B61C 13/04 105/148
2005/0172563 A1 * 8/2005 Komoda ..... A47H 5/0325 49/358
2006/0230684 A1 * 10/2006 Poole ..... E05D 15/0634 49/409
2007/0017065 A1 1/2007 Hutnik et al.
2008/0148643 A1 * 6/2008 Lemming ..... E05D 15/0617 49/409
2008/0202032 A1 8/2008 Loidolt
2008/0258480 A1 10/2008 Seiss et al.
2009/0019665 A1 1/2009 Kelley
2009/0100760 A1 * 4/2009 Ewing ..... E05B 65/0876 49/410
2010/0011684 A1 1/2010 Neal
2010/0242365 A1 * 9/2010 Langner ..... E05D 15/0686 49/130
2011/0061305 A1 * 3/2011 Quesada ..... E05D 15/0665 49/425
2011/0197515 A1 * 8/2011 Joray ..... E05D 15/0665 49/425
2015/0041078 A1 * 2/2015 Perache ..... A47H 1/04 160/331
2016/0138313 A1 * 5/2016 Kreyenborg ..... E05D 15/0634 49/409
2017/0198510 A1 * 7/2017 Shin ..... E06B 3/4636
2017/0198511 A1 * 7/2017 Shin ..... E05F 5/003
2018/0058122 A1 * 3/2018 Lang ..... E05D 15/0665
2019/0226257 A1 * 7/2019 Fontijn ..... E05D 15/0665

OTHER PUBLICATIONS

International Search Report of PCT/US2017/051565 dated Jan. 29, 2018.

* cited by examiner

SLIDING DOOR AND WINDOW ROLLER ASSEMBLY

CROSS-REFERENCES TO RELATED APPLICATIONS

This application is based on and claims priority from U.S. Provisional Application No. 62/395,014 filed on Sep. 15, 2016, the entire contents of which are incorporated herein by reference.

BACKGROUND

1. Field

Exemplary embodiments relate to sliding doors and windows, and more particularly, to an assembly allowing automatic and manual adjustments of roller mechanisms to compensate for construction tolerances and building movement.

2. Description of the Related Art

Conventional methods and apparatuses for installing doors and windows fix the outer frame to the building, and the inner frame or sash of the door or window slides along the outer frame.

Conventional methods of installing doors and windows, however, do not compensate for installation tolerances, building movement, or settlement of the building.

Exemplary embodiments overcome these shortcomings associated with the prior methods and apparatuses for installing doors and windows. The exemplary embodiments provide a unique pivoting mechanism to combine automatic and manual adjustment methods to compensate for these construction tolerances/building movements.

SUMMARY OF THE INVENTION

One or more exemplary embodiments include a sliding roller assembly. Additional aspects will be set forth in part in the description which follows and, in part, will be apparent from the description, or may be learned by practice of the exemplary embodiments.

According to another exemplary embodiment, a sliding roller assembly, including a plurality of blocks, configured to be connected in series, at least one roller device provided between each of the plurality of blocks, where the roller device includes a main body having at least one roller bearing disposed in the main body.

According to another exemplary embodiment, the plurality of blocks are fixed to a door frame or a window frame.

According to another exemplary embodiment, the body further includes at least one through hole, and a shaft provided in the through hole which extends into a hole in a body of at least one of the plurality of blocks.

According to another exemplary embodiment, a sleeve is provided on an end of the shaft and at least part of the sleeve is disposed in the hole.

According to another exemplary embodiment, the sliding roller assembly further includes a moving member that contacts the at least one roller bearing and slides with respect to the plurality of blocks and the at least one roller bearing.

According to another exemplary embodiment, a thickness of at least one of the plurality of blocks is greater than a thickness of the at least one roller device.

In accordance with one aspect of an exemplary embodiment, a sliding roller assembly includes a body, at least one cavity extending into the body from a first side of the roller device at least one roller bearing disposed within the at least one cavity, secured in the cavity by a roller bearing shaft; and at least one hole on a second side of the roller device, perpendicular to the first side, and configured to receive a shaft.

According to another exemplary embodiment, the at least one hole extends through the body of the roller device.

According to another exemplary embodiment, a sleeve is provided on at least one end of the shaft.

According to another exemplary embodiment, the at least one roller bearing is angled away from a center of the body.

According to another exemplary embodiment, the at least one roller bearing is angled toward a center of the body.

In accordance with one aspect of an exemplary embodiment, a sliding assembly is configured to move a door or window and includes a frame, a sliding mechanism disposed within the frame, and a moving member configured to contact the sliding member and move along the sliding member to move a window or a door.

According to another exemplary embodiment, the sliding mechanism includes a plurality of blocks and a roller device, provided between and connected to each of the plurality of blocks, including at least one bearing, such that the moving member is configured to slide along the at least one bearing.

According to another exemplary embodiment, the roller device is connected to the plurality of blocks by a shaft provided in a through hole in the roller device.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

Exemplary embodiments may allow various changes or modifications, including various changes in form, and specific exemplary embodiments will be illustrated in drawings and described in detail in the specification. However, it should be understood that the specific exemplary embodiments do not limit the present inventive concept to a specific disclosing form but include every modified, equivalent, or replaced one within the spirit and technical scope of the present inventive concept. In the following description, well-known functions or constructions are not described in detail since they would obscure the invention with unnecessary detail.

The terminology used in the application is used only to describe specific exemplary embodiments and does not have any intention to limit the present inventive concept. Although general terms as currently widely used as possible are selected as the terms used in the present inventive concept while taking functions in the exemplary embodiments into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the invention. Accordingly, the terms used in the present inventive concept should be defined not by simple names of the terms but by the meaning of the terms and the content over the present inventive concept.

Figure 1:
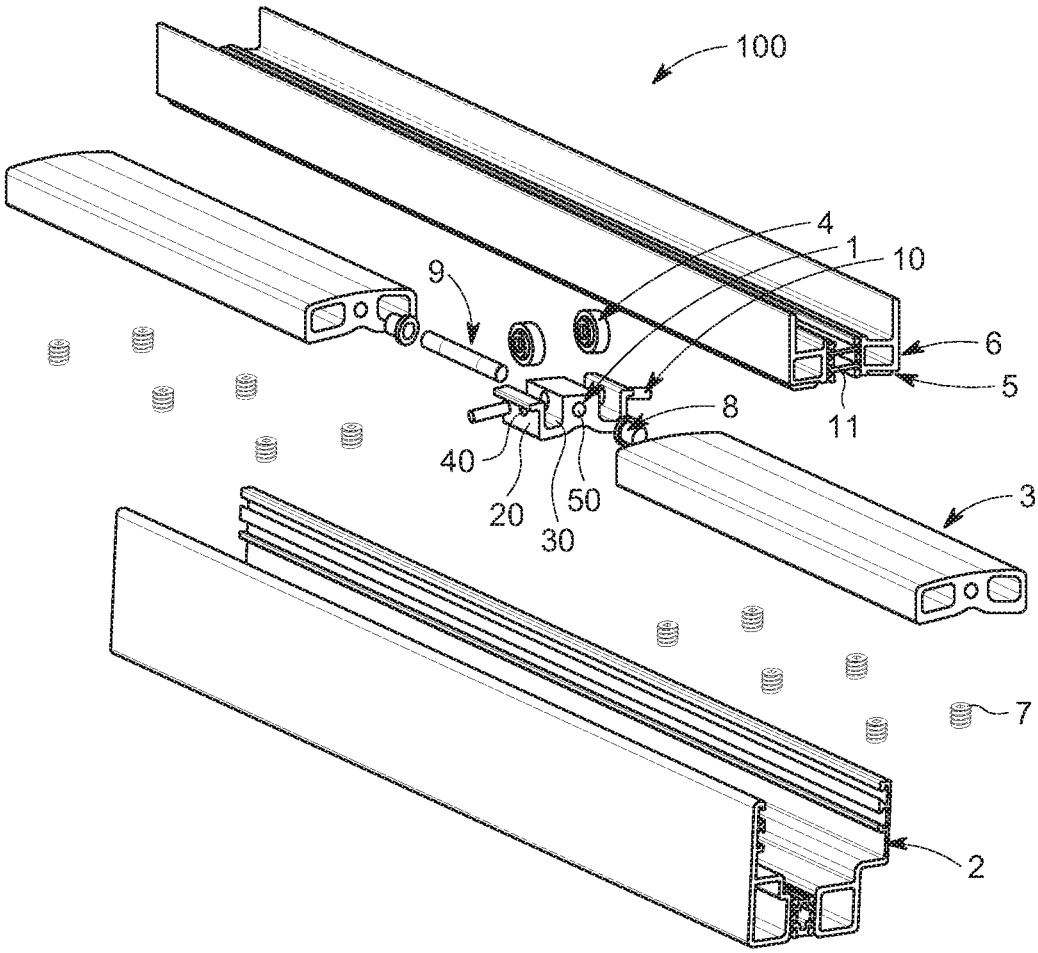
FIG. 1 is an exploded perspective view of a sliding roller assembly according to exemplary embodiment.
Figure 3:
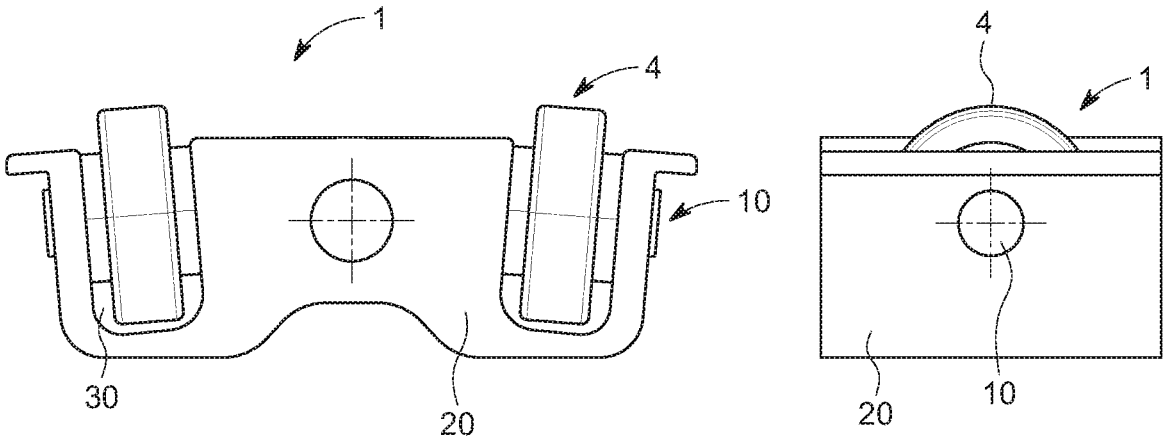
FIG. 3 is a view of a roller device of a sliding roller assembly according to an exemplary embodiment.

As shown in the drawings, with reference made to the reference numerals in FIG. 1, the sliding roller assembly 100 according to an exemplary embodiment includes a plurality of blocks 3 connected in series and at least one roller device 1 provided between and interconnecting adjacent blocks 3 such that the sliding roller assembly 100 extends in a longitudinal direction. The sliding roller assembly 100 further includes a moving member 6 which may contact and move along the roller device 1. As shown in FIG. 3, the roller device 1 includes a main body 20 having at least one cavity 30 extending therein from a first side of the roller device. At least one roller bearing 4 is disposed within the cavity 30, and secured in the cavity by a bearing shaft 10 supported at each end by the main body 20. Further, it will be understood that the roller bearing 4 may be secured to an outer side of the roller device 1. The roller bearing 4 may be angled toward an outside or an inside of the roller device 1 or may be perpendicular to a bottom of the roller device 1.

The main body also has at least one through hole 50 extending from a second side of the main body to an opposite third side, both being perpendicular to the first side. The through hole 50 is configured to receive a shaft 9 having end portions extending from the opposing second and third sides of the main body and extending in the longitudinal direction, as shown in FIGS. 1 and 2.

Figure 2:
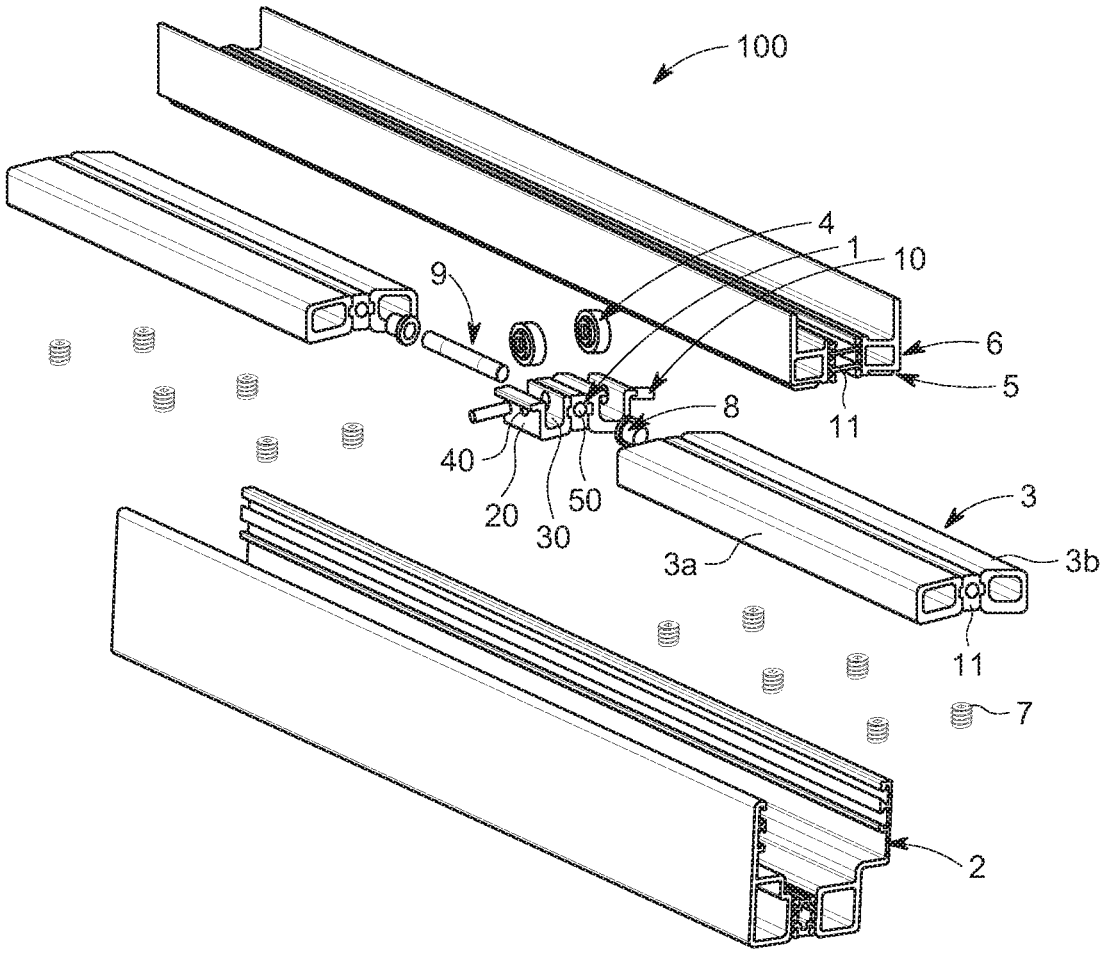
FIG. 2 is an exploded perspective view of a sliding roller assembly according to another exemplary embodiment.

FIGS. 1 and 2 illustrate a sleeve 8 provided on each exposed end portion of the shaft 9. One of the sleeves 8 is received in a hole 50 provided in the longitudinal end face of one of the blocks 3 and the opposing sleeve 8 is received in the end hole 50 of the longitudinal end face of another block 3 such that the roller device 1 interconnects the adjacent blocks 3. The end portions of the shafts 9 are rotatably held in the sleeves 8 such that the roller device 1 can rotate around the axis of the shaft 9 and with respect to the plurality of blocks 3. Thus, the sleeves 8 allow for improved swiveling movement of the main body 20 with respect to the blocks. However, it will be understood that the sleeve 8 is but one exemplary embodiment, and the swiveling movement can be effected without the use of the sleeve 8. For example, it will be understood by those skilled in the art that the swiveling may be achieved using only a washer on a shaft or by inserting the shaft 9 into the hole 50 without a washer or a sleeve 8.

The plurality of blocks 3 and associated roller device may be disposed within a bottom of a door frame or a window frame 2, as shown in FIGS. 1 and 2. However, it will be understood that the plurality of blocks 3 can be attached to a top portion of a door frame or a window frame, as well. A set of screws or various leveling devices 7 can be screwed or set beneath the plurality of blocks 3 to fix or align the plurality of blocks 3 to the door or window frame 2. This ensures that the entire sliding roller assembly 100 is perfectly level across each individual portion of the sliding roller assembly 100. One or more of the plurality of blocks 3 can be removed from the door frame or window frame 2 and the screws or leveling devices 7 can be adjusted to ensure that the sliding door is level, which is important in high-tolerance sliding door and window systems. Further, each roller device 1 can be individually leveled to adjust the height of the roller device 1 with respect to the plurality of blocks 3. In addition, the plurality of blocks 3 may include other features known to one of ordinary skill in the art.

In one embodiment, the thickness of the roller device 1 in a direction perpendicular to or parallel to a moving direction of the moving member 6 is less than the thickness of the plurality of blocks 3. However, it will be understood that the thickness of the roller devices 1 and the blocks 3 can vary. Further, the dimensions of the roller device 1 and the plurality of blocks 3, including but not limited to the height and width, can vary depending on the requirements of the door or window frame.

Figure 4:
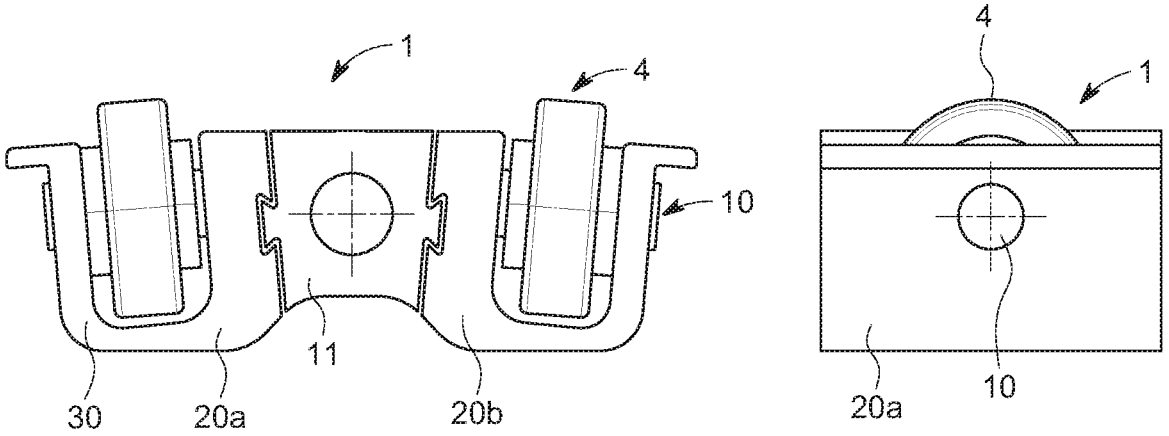
FIG. 4 is a view of a roller device of a sliding roller assembly according to another exemplary embodiment.
Figure 7:
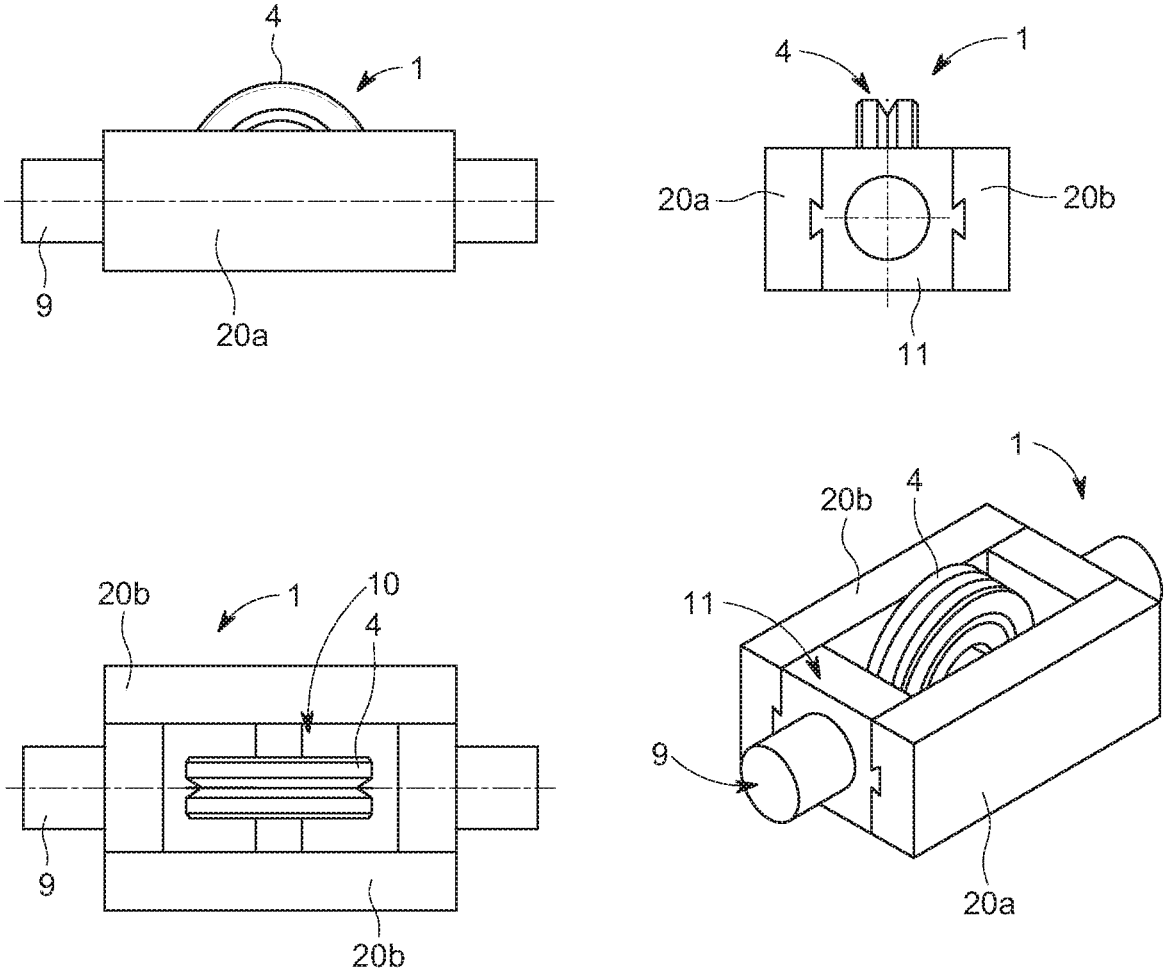
FIG. 7 is a perspective view of a roller device of a sliding roller assembly according to another exemplary embodiment.

Further, it will be understood that the sliding roller assembly 100 and/or the blocks 3 may include a thermal break 11 formed from a thermally separating material to reduce the thermal conductivity of the assembly. For example, as shown in FIGS. 4 and 7, the sides 20*a*, 20*b* of a roller device 1 can be connected by the thermal break 11, which can reduce the thermal conductivity of the assembly. FIG. 2 similarly illustrates a thermal break 11 connecting the two side portions 3*a*, 3*b* blocks 3.

Figure 6:
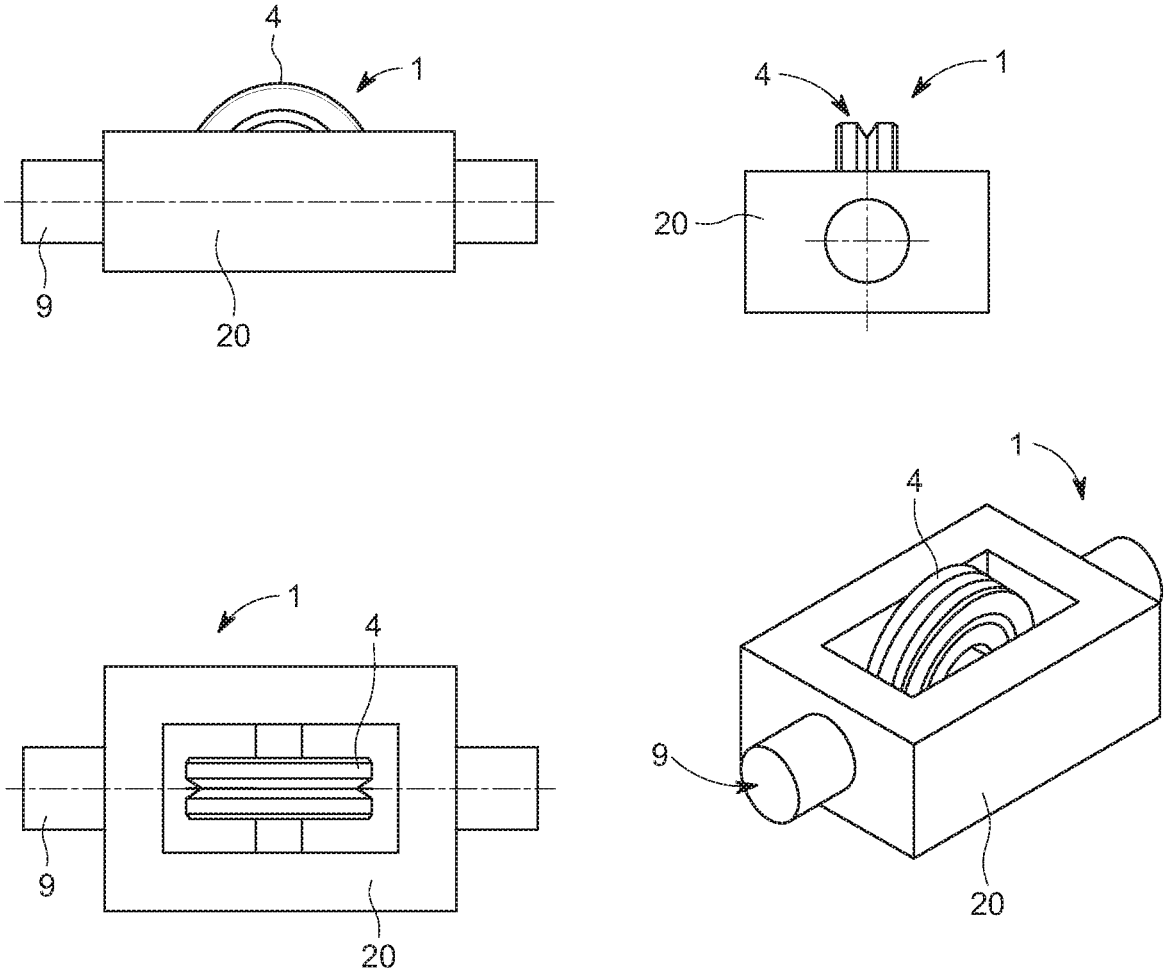
FIG. 6 is a perspective view of a roller device of a sliding roller assembly according to an exemplary embodiment.

As shown in FIGS. 6 and 7, in an alternative embodiment the roller device 1 may include a single bearing 4 located centrally between the side 20*a* and 20*b*. A thermal break 11 is similarly provided between two side portions 20*a*, 20*b* of the roller device 1 as shown.

As shown in FIG. 1, the sliding roller assembly 100 further includes the moving member 6, which contacts the roller bearing 4 and slides with respect to the plurality of blocks 3 and the roller device 1. The moving member 6 supports the glass of a door or window such that the door or window can be easily opened or closed by a sliding movement of the moving member 6 on the sliding roller assembly 100. The moving member may also include a strip 5 on a bottom portion thereof which aids in reducing the friction between the moving member 6 and the roller bearing 4 during movement. The strip 5 can made of brass or any other material known in the art that can reduce friction. According to one exemplary embodiment, the moving member 6 may also include a thermal break 11.

Figure 5:
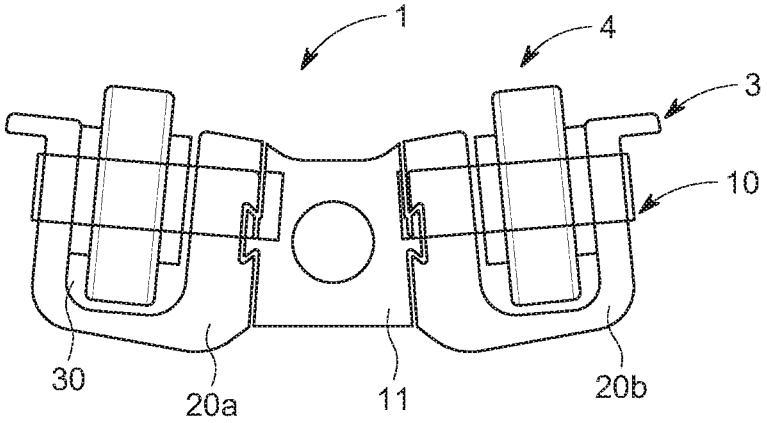
FIG. 5 is a view of a roller device of a sliding roller assembly according to another exemplary embodiment which includes a thermal break.

FIGS. 5 and 6 illustrate that the roller bearings 4 can be angled either toward a center of the roller device 1 or away from a center of the roller device 1. This allows the moving member 6 to slide smoothly, even if the building in which the sliding roller assembly 100 is installed has moved or due to installation tolerances.

Further, the assembly provides for adjustability in multiple dimensions. For example, the roller device 1 can be moved axially along the shaft 9 closer to or further from the blocks 3. The roller device 1 is also capable of rotating about the axis of the shaft 9 as discussed above. The roller bearings 4 are also capable of moving laterally along the bearing shaft 10 within the groove of the body. Thus, the shafts 9, sleeves 8, and roller bearings 4 may be configured to permit relative movement of the blocks 3 with respect to the roller device 1 in at least three directions. That is, the roller device 1 may move in three degrees of freedom laterally with respect to the blocks 3, rotationally with respect to the blocks 3 and axially with respect to the shaft 9.

The above-described sliding roller assembly allows the moving member 6 of a window or door to slide smooth within the frame or sash. Since the roller bearings 4 and the shaft-and-sleeve 9, 8 assembly allow the roller device 1 to move on three axes, the sliding roller assembly 100 compensates for any misalignments due to installation tolerances, building movements, and/or settlement of the building and thereby avoid significant impact on the force required to move sliding panels.

While the exemplary embodiments have been particularly shown and described, it will be understood by those of ordinary skill in the art that various changes in form and details may be made therein without departing from the spirit and scope of the inventive concept as defined by the appended claims.

What is claimed is:

1. A sliding roller assembly, comprising:

a plurality of blocks, configured to be connected in series;

at least one roller device provided between and connected to each of the plurality of blocks, wherein the roller device includes a main body having at least one roller bearing disposed in the main body, the main body further includes at least one through hole, and a shaft provided in the through hole which extends into a hole in a body of at least one of the plurality of blocks.

2. The sliding roller assembly of claim 1, wherein the plurality of blocks are fixed to or placed in a door frame or a window frame.

3. The sliding roller assembly of claim 1, wherein a sleeve is provided on an end of the shaft and at least part of the sleeve is disposed in the hole.

4. The sliding roller assembly of claim 1, wherein a washer is provided on the shaft.

5. The sliding roller assembly of claim 1, further comprising:

a moving member that contacts the at least one roller bearing and slides with respect to the plurality of blocks and the at least one roller bearing and supports a window or a door provided on the moving member.

6. The sliding roller assembly of claim 1, wherein a thickness of at least one of the plurality of blocks is greater than a thickness of the at least one roller device.

7. The sliding roller assembly of claim 1, wherein the plurality of blocks are configured to be connected in series in a first direction, the at least one roller device is provided between the plurality of blocks in the first direction, and the through hole of the main body, and the shaft that is provided within the through hole, extend through the main body in the first direction.

8. The sliding roller assembly of claim 1, wherein the roller device further includes at least one cavity extending into the main body from a first side of the roller device, the at least one roller bearing is disposed within the at least one cavity, secured in the cavity by a roller bearing shaft, and the at least one through hole of the main body of the roller device is on a second side of the roller device, perpendicular to the first side, and is configured to receive the shaft in a direction perpendicular to an extending direction of the roller bearing shaft.

9. The sliding roller assembly of claim 8, wherein the at least one through hole extends through the main body of the roller device.

10. The sliding roller assembly of claim 8, wherein a sleeve or a washer is provided on at least one end of the shaft.

11. The sliding roller assembly of claim 8, wherein the at least one roller bearing is tilted away from a center of the main body.

12. The sliding roller assembly of claim 8, wherein the at least one roller bearing is tilted toward a center of the main body.

13. A sliding roller assembly configured to move a door or a window, comprising:

a frame;

a sliding mechanism disposed within the frame; and a moving member configured to contact the sliding mechanism and move along the sliding mechanism to move the window or the door, wherein the sliding mechanism comprises:

a plurality of blocks; and a roller device, provided between and connected to each of the plurality of blocks, including at least one bearing, the moving member is configured to slide along the at least one bearing, and the roller device is connected to the plurality of blocks by a shaft provided in a through hole in the roller device which extends into a hole of a body of at least one of the plurality of blocks.

* * * * *